US012071825B2

(12) United States Patent
Giem et al.

(10) Patent No.: US 12,071,825 B2
(45) Date of Patent: Aug. 27, 2024

(54) ANNULAR CUTTER CATCHING DEVICES

(71) Applicant: Schlumberger Technology Corporation, Sugar Land, TX (US)

(72) Inventors: Gregory Giem, Sugar Land, TX (US); Benjamin Jean Yvon Durand, Houston, TX (US); Matthew Dresel, Sugar Land, TX (US); Jessica Schulz, Sugar Land, TX (US); Quentin Smith, Richmond, TX (US); Joshua Wurtz, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/257,694

(22) PCT Filed: Dec. 13, 2021

(86) PCT No.: PCT/US2021/063059

§ 371 (c)(1),
(2) Date: Jun. 15, 2023

(87) PCT Pub. No.: WO2022/132624

PCT Pub. Date: Jun. 23, 2022

(65) Prior Publication Data

US 2024/0052718 A1 Feb. 15, 2024

Related U.S. Application Data

(60) Provisional application No. 63/127,645, filed on Dec. 18, 2020.

(51) Int. Cl.
*E21B 31/00* (2006.01)

(52) U.S. Cl.
CPC ..... *E21B 31/002* (2013.01)

(58) Field of Classification Search
CPC ..... E21B 31/002
(Continued)

(56) References Cited

U.S. PATENT DOCUMENTS 3,023,810 A * 3/1962 Anderson ..... E21B 27/005 166/227
3,283,823 A * 11/1966 Warrington ..... E21B 33/127 166/182

(Continued)

FOREIGN PATENT DOCUMENTS

| | | |
|---|---|---|
| CN | 203879437 | 10/2014 |
| CN | 210003232 | 1/2020 |
| CN | 211549632 | 9/2020 |

OTHER PUBLICATIONS

International Preliminary Report on Patentability issued in International Patent application PCT/US2021/063059 dated Jun. 29, 2023, 8 pages.

(Continued)

*Primary Examiner* — Taras P Bemko
(74) *Attorney, Agent, or Firm* — Jeffrey D. Frantz

(57) ABSTRACT

An annular cutter catching device includes a housing having an inner bore therethrough, a cutter configured to cut a coupon, and a coupon catching device configured to grip an outer surface of the coupon. In an embodiment, an annular cutter catching device includes one or more split rings disposed within the inner bore of the housing. In the embodiment, at least one split ring is configured to grip an outer surface of the coupon within the inner bore of the housing. In an embodiment, an annular cutter catching device includes a coupon catcher disposed within the inner bore of the housing. In an embodiment, the coupon catcher includes a set of fingers movable between an open position and a closed position. In an embodiment, the set of fingers (Continued)

are configured to retain the coupon within the inner bore of the housing in the closed position.

20 Claims, 7 Drawing Sheets

(58) Field of Classification Search
USPC ..... 166/301
See application file for complete search history.

(56) References Cited

U.S. PATENT DOCUMENTS 4,059,155 A * 11/1977 Greer ..... E21B 31/08 166/99
4,276,931 A * 7/1981 Murray ..... E21B 23/004 166/99
4,296,822 A * 10/1981 Ormsby ..... E21B 25/10 175/255
4,688,638 A 8/1987 Williams
6,964,303 B2 11/2005 Mazorow
9,284,807 B1 * 3/2016 Beynon ..... E21B 25/04
10,711,551 B2 * 7/2020 Al-Ramadhan ..... E21B 31/18
2020/0157903 A1 * 5/2020 Al-Mousa ..... E21B 29/002

OTHER PUBLICATIONS

International Search Report and Written Opinion issued in International Patent application PCT/US2021/063059 on Mar. 29, 2022, 9 pages.
Welltec, Well Miller(r) mills eight balls and baffle seats in under 24 hours, downloaded from https://www.welltec.com/case-story/well-miller-mills-eight-balls-and-baffle-seats-in-under-24-hours/, 2023, 3 pages.
Baker Hughes, FracPoint Openhole Fracture Completion System, video viewed at https://www.youtube.com/watchv=s5ZQCRRZZXE, 2011.

* cited by examiner

ANNULAR CUTTER CATCHING DEVICES

CROSS-REFERENCE TO RELATED APPLICATIONS

This present application is the National Stage Entry of International Application No. PCT/US2021/063059, filed on Dec. 13, 2021, which claims priority benefit of U.S. Provisional Application No. 63/127,645, filed on Dec. 18, 2020, the entirety of which is incorporated by reference herein and should be considered part of this specification.

BACKGROUND

The subject matter disclosed herein relates to annular cutter catching devices and, more particularly, to annular catching devices for use with downhole coring tools.

Production of a wellbore may necessitate forming plugs, such as a ball and seat, to isolate portions of the wellbore. The seat may include an annular ring with an inner diameter smaller than an outer diameter of the ball to catch the ball. In certain instances, removal of the plugs may be necessary, e.g., to extract resources from another portion of the wellbore or perform another process in the oil and gas industry. An annular cutting device cuts a coupon, or portion, out of the plug to allow movement of resources and/or tools through the previously isolated portion of the wellbore.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

An annular cutting device cuts a coupon, or portion or remnant, out of a plug or other obstruction to allow movement of resources and/or tools through a previously isolated portion of the wellbore. The coupon may be generally shaped like a cylindrical, disc, moon or other arc shape, or be irregularly shaped or otherwise include chamfers and other features; a coupon that is cylindrically shaped may also be tubular and may include chamfers and other features on an inner surface. After cutting, the coupon may be left downhole in the wellbore. However, the coupon may interfere with production and/or other interventions if left within the wellbore. Additionally, milling may produce debris and/or cuttings that may interfere with production and/or other intervention operations if left within the wellbore. In certain embodiments, an annular cutter catching device may be used to grip and/or retain the coupon after cutting. In particular, in certain embodiments, the annular cutter catching device may grip the coupon about an outer surface.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
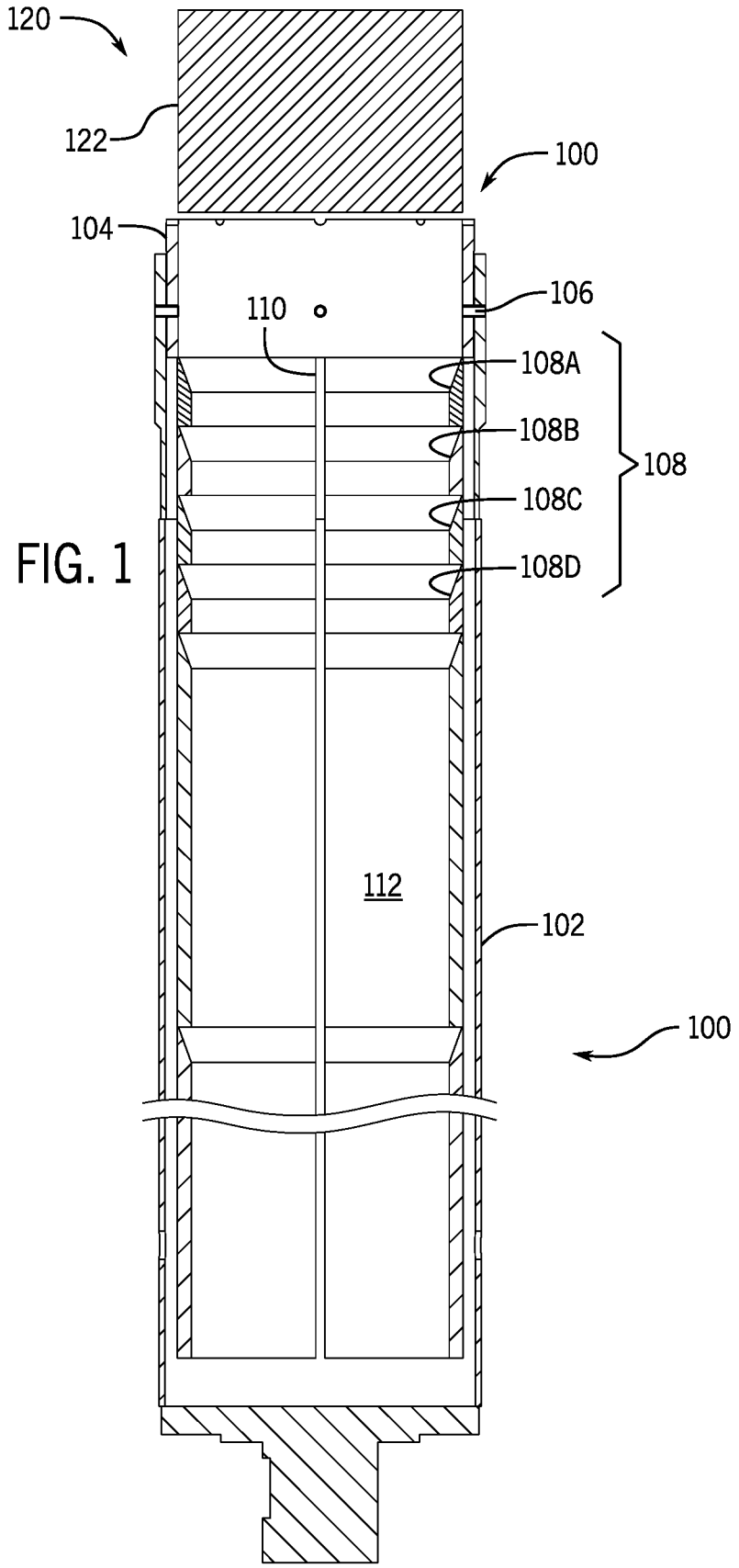
FIG. 1 depicts a schematic diagram of an annular cutter catching device having one or more split rings, in accordance with embodiments of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain examples commensurate in scope with the originally claimed subject matter are discussed below. These examples are not intended to limit the scope of the disclosure. Indeed, the present disclosure may encompass a variety of forms that may be similar to or different from the examples set forth below.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase "A based on B" is intended to mean that A is at least partially based on B. Moreover, unless expressly stated otherwise, the term "or" is intended to be inclusive (e.g., logical OR) and not exclusive (e.g., logical XOR). In other words, the phrase "A or B" is intended to mean A, B, or both A and B.

The oil and gas industry includes a number of sub-industries, such as exploration, drilling, logging, extraction, transportation, refinement, retail, and so forth. During exploration and drilling, wellbores may be drilled into the ground for reasons that may include discovery, observation, and/or extraction of resources. These resources may include oil, gas, water, or any other combination of elements within the ground.

Wellbores, sometimes called boreholes, may be straight or curved holes drilled into the ground from which resources may be discovered, observed, and/or extracted. Moreover, the wellbores may have horizontally drilled sections to increase production and/or efficiency. After the formation of a wellbore, well logging and production may be practiced. Well logging may include making a detailed record of the geological formations penetrated by a wellbore, and may also be practiced during creation (e.g., drilling) of the wellbore. Production may include the extraction of resources from within the wellbore.

Production of a wellbore may necessitate forming plugs, such as a ball and seat, to isolate portions of the wellbore. The seat may include an annular ring with an inner diameter smaller than an outer diameter of the ball in order to catch the ball. In certain instances, removal of the plugs may be necessary (e.g., to extract resources from another portion of the wellbore or perform another process in the oil and gas industry). In certain embodiments, an annular cutting device cuts a coupon, or portion, out of the plug to allow movement of resources and/or tools through the previously isolated portion of the wellbore.

After cutting, the coupon may be left downhole in the wellbore. However, the coupon may interfere with production and/or other interventions if left within the wellbore. In certain embodiments, an annular cutter catching device may grip and/or retain the coupon after cutting to retrieve the coupon to the surface. Retrieving the coupon to the surface with the annular cutting device prevents further interference in production and/or other inventions. In certain embodiments, the annular cutter catching device may grip and/or retain multiple coupons during a single trip into the wellbore.

FIG. 1 depicts a schematic diagram of an annular cutter catching device 100 having one or more split rings 108, in accordance with embodiments of the present disclosure. In certain embodiments, the annular cutter catching device 100 may include a housing 102, a cutter 104, a pin 106, and one or more split rings 108. The housing 102 may be a tubular mandrel having an inner bore 112 therethrough. The cutter 104 may cut a coupon 120. In certain embodiments, the cutter 104 may be coupled to the housing 102. For example, the pin 106 may couple the cutter 104 to the housing 102. Additionally or alternatively, the cutter 104 may be coupled to the housing by a threaded connection, welding, or any other suitable connection.

Each of the one or more split rings 108 may receive the coupon 120 (e.g., an annular coupon) within an inner diameter of the respective split ring 108. Each of the one or more split rings 108 may grip and/or retain the coupon 120. In certain embodiments, the one or more split rings 108 may be disposed within the inner bore 112 of the housing 102. For example, split rings 108A, 108B, 108C, and 108D may be disposed within the inner bore 112 of the housing 102. In certain embodiments, split ring 108A may include a tapered surface, which may be formed at one end of the split ring 108A. In certain embodiments, the tapered surface of the split ring 108A may extend from an inner diameter of the split ring 108A to an outer diameter of the split ring 108A. In certain embodiments, a diameter of the split ring 108A at the tapered surface may increase linearly from the inner diameter to the outer diameter.

In certain embodiments, the inner diameter of the split ring 108A may be smaller than an inner diameter of the cutter 104. For example, the inner diameter of the split ring 108A may be five percent smaller, or even less, than an inner diameter of the cutter 104. In certain embodiments, the split ring 108A may include an annular gap 110 around a circumference of the split ring 108A, which may axially run generally parallel to a longitudinal axis of the annular cutter catching device 100. The annular gap 110 may permit the split ring 108A to expand. For example, the annular gap 110 may permit the inner diameter of the split ring 108A to increase when receiving the coupon 120. Additionally, the split ring 108A may be movably disposed in the housing 102. For example, the split ring 108A may not be in contact with the housing 102 in an expanded state and may move within the housing 102. In certain embodiments, the annular gap 110 may span up to ninety degrees, or up to one quarter, of the circumference of the split ring 108A. The inner diameter of the split ring 108A may be configured to grip and/or retain the coupon 120. For example, the inner diameter of the split ring 108A may exert a compressive force and/or a frictional force on an outer surface 122 of the coupon 120.

In certain embodiments, the split rings 108B, 108C, 108D may have a similar construction to the split ring 108A. The one or more split rings 108 may permit a coupon to pass through to a successive split ring 108 of the one or more split rings 108 along the longitudinal axis of the annular cutter catching device 100. For example, the split ring 108A may allow a coupon to pass through to split ring 108B. In certain embodiments, a successive split ring of the one or more split rings 108 may have a smaller inner diameter than an inner diameter of a preceding split ring of the one or more split rings 108. For example, the inner diameter of the split ring 108B may be smaller than an inner diameter of the split ring 108A, the inner diameter of the split ring 108C may be smaller than an inner diameter of the split ring 108B, and the inner diameter of the split ring 108D may be smaller than an inner diameter of the split ring 108C. In certain embodiments, an inner diameter of the one or more split rings 108 may have a coating disposed thereon. For example, the coating may be a frictional coating, which may increase a frictional force designed to grip and/or retain a coupon.

In certain embodiments, the one or more split rings 108 may be replaced with a plurality of stiff wire bristles and/or wire brushes. The stiff wire bristles may be mounted to an inner surface of the housing 102. For example, the stiff wire bristles may be mounted in a direction extending towards the longitudinal axis of the annular cutter catching device. In certain embodiments, the plurality of stiff wire bristles may be angled relative to a perpendicular direction from the longitudinal axis of the annular cutter catching device. The plurality of stiff wire bristles may retain and/or grip an outer surface (e.g., outer surface 122 of the coupon 120 in FIG. 1) of the coupon.

Figure 2:
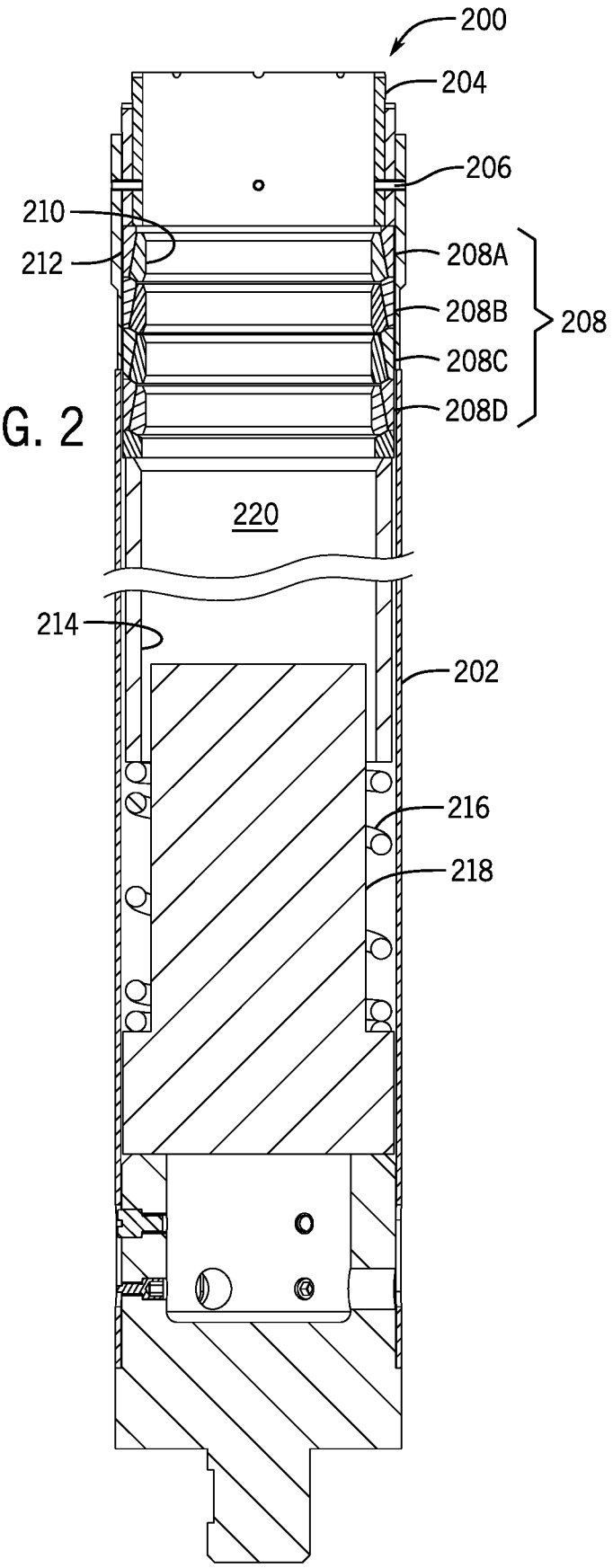
FIG. 2 depicts a schematic diagram of an annular cutter catching device having one or more slips, in accordance with embodiments of the present disclosure.

FIG. 2 depicts a schematic diagram of an annular cutter catching device 200 having one or more slips 208, in accordance with embodiments of the present disclosure. In certain embodiments, the annular cutter catching device 200 may include a housing 202, a cutter 204, a pin 206, and one or more slips 208. The housing 202 may be a tubular mandrel having an inner bore 220 therethrough. The cutter 204 may cut a coupon. In certain embodiments, the cutter 204 may be coupled to the housing 202. For example, the pin 206 may couple the cutter 204 to the housing 202. Additionally or alternatively, the cutter 204 may be coupled to the housing 202 by a threaded connection, welding, or any other suitable connection.

Each of the one or more slips 208 may receive a coupon. In certain embodiments, the one or more slips 208 may be movable between a first position and a second position. Each of the one or more slips 208 may grip and/or retain a coupon in the second position. In certain embodiments, the slip 208A may include an inner ring 210 and an outer ring 212. In certain embodiments, the inner ring 210 may be disposed within the outer ring 212. In certain embodiments, the inner ring 210 may be formed of an elastomeric material. In certain embodiments, the inner ring 210 may have a tapered surface at an outer diameter of the inner ring 210, and the outer ring 212 may have a matching tapered surface at an inner diameter of the outer ring 212. A force acting on the inner ring 210 in the direction of the cutter 204 may move the inner ring 210 along the matching tapered surface of the outer ring 212. For example, the inner ring 210 may be forced inward towards a longitudinal axis of the annular cutter catching device 200. The movement of the inner ring 210 may increase a force acting on a coupon to grip and/or retain the coupon.

In certain embodiments, the slips 208B, 208C, 208D may have a similar construction to the slip 208A. The one or more slips 208 may allow a coupon to pass through to a successive slip of the one or more slips 208 along the longitudinal axis of the annular cutter catching device 200. For example, the slip 208A may allow a coupon to pass through to the slip 208B. A successive slip of the one or more slips 208 may have a smaller inner diameter than a preceding slip 208 of the one or more slips 208. For example, the inner diameter of the slip 208B may be smaller than an inner diameter of the slip 208A, the inner diameter of the slip 208C may be smaller than an inner diameter of the slip 208B, and the inner diameter of the slip 208D may be smaller than an inner diameter of the slip 208C.

In certain embodiments, the annular cutter catching device 200 may include an inner mandrel 214, a spring 216, and a stopper 218. In certain embodiments, the inner mandrel 214 may be disposed within the inner bore 220 of the housing 202. In certain embodiments, the inner mandrel 214 may be a tubular mandrel having an inner bore therethrough. In certain embodiments, a first surface of the inner mandrel 214 may abut the last slip 208 of the one or more slips 208 along the longitudinal axis of the annular cutter catching device 200. For example, the inner mandrel 214 may abut the slip 208D. The spring 216 may be disposed within the inner bore 220 of the housing 202. In certain embodiments, the spring 216 may be disposed between the inner mandrel 214 and a first portion of the stopper 218. In certain embodiments, the spring 216 may act against a second surface of the inner mandrel 214, which may be located at an opposite axial end of the inner mandrel 214 from the first surface of the inner mandrel 214 that abuts the last slip 208. In certain embodiments, the spring 216 may be radially disposed about a second portion of the stopper 218. In certain embodiments, the stopper 218 may be coupled to the housing 202. The spring 216 may apply a force to at least one of the one or more slips 208 in the direction of the cutter 204. The applied force of the spring 216 may move the inner ring 210 along the matching tapered surface of the outer ring 212 of a slip 208. In response, the inner ring 210 of the slip 208 may be forced inward towards a longitudinal axis of the annular cutter catching device 200. The movement of the inner ring 210 of the slip 208 may increase a force acting on a coupon to grip and/or retain the coupon.

Figure 3:
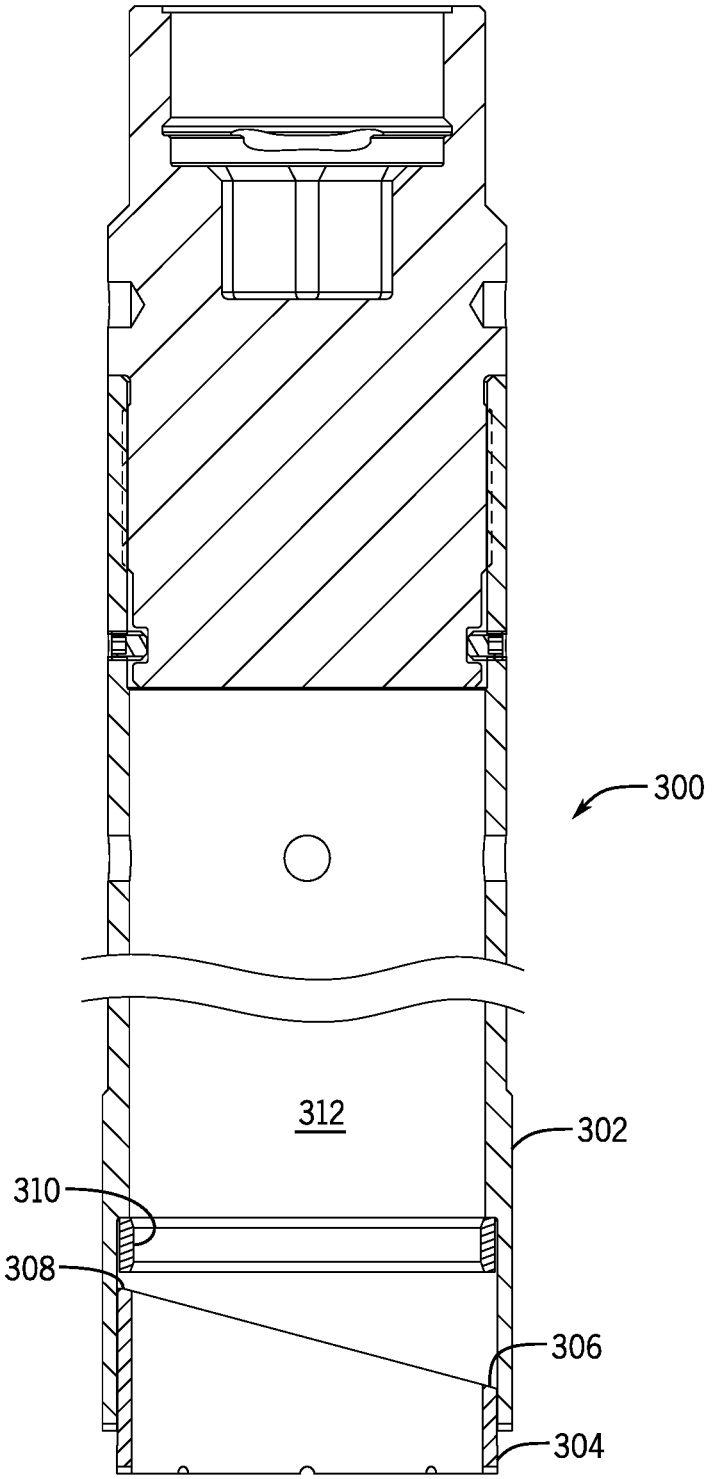
FIG. 3 depicts a schematic diagram of an annular cutter catching device having a cutter with an asymmetric surface, in accordance with embodiments of the present disclosure.

FIG. 3 depicts a schematic diagram of an annular cutter catching device 300 having a cutter 304 with an asymmetric surface, in accordance with embodiments of the present disclosure. In certain embodiments, the annular cutter catching device 300 may include a housing 302, the cutter 304, and a catch ring 310. The housing 302 may be a tubular mandrel having an inner bore 312 therethrough. The cutter 304 may cut a coupon. In certain embodiments, the cutter 304 may be coupled to the housing 302. The cutter 304 may include a cutting surface to cut a coupon. In certain embodiments, the cutter 304 may have an asymmetric surface opposite of the cutting surface. For example, as illustrated, the cutter 304 may have a tapered height. The cutter 304 may have a minimum height at a first point 306 of the asymmetric surface and a maximum height at a second point 308 of the asymmetric surface. In certain embodiments, the height of the cutter 304 may decrease linearly about the circumference of the asymmetric surface from the maximum height at the second point 308 to the minimum height at the first point 306.

In certain embodiments, the catch ring 310 may be disposed within the inner bore 312 of the housing 302. In certain embodiments, the catch ring 310 may be disposed adjacent the asymmetric surface of the cutter 304. In certain embodiments, the catch ring 310 may be formed of an elastomeric material. Additionally or alternatively, the catch ring 310 may be formed of a metal material, a metal material having an elastomeric material on an inner surface, or any other suitable material for retaining and/or gripping the coupon. The catch ring 310 may receive a coupon within an inner diameter. For example, the catch ring 310 may retain and/or grip the coupon with an inner surface of the catch ring 310. For example, an axial force in the direction of the cutter 304 may move the catch ring 310 and the retained coupon towards the cutter 304. In response, the catch ring 310 may contact the cutter 304 at the asymmetric surface. For example, the catch ring 310 may contact the cutter 304 at the second point 308. In certain embodiments, the asymmetric surface of the cutter 304 at the second point 308 may restrict motion of the catch ring 310. For example, the catch ring 310 may be configured to pivot about the second point 308. The pivoting motion of the catch ring 310 may increase a frictional force of the catch ring 310 about the retained coupon.

Figure 4:
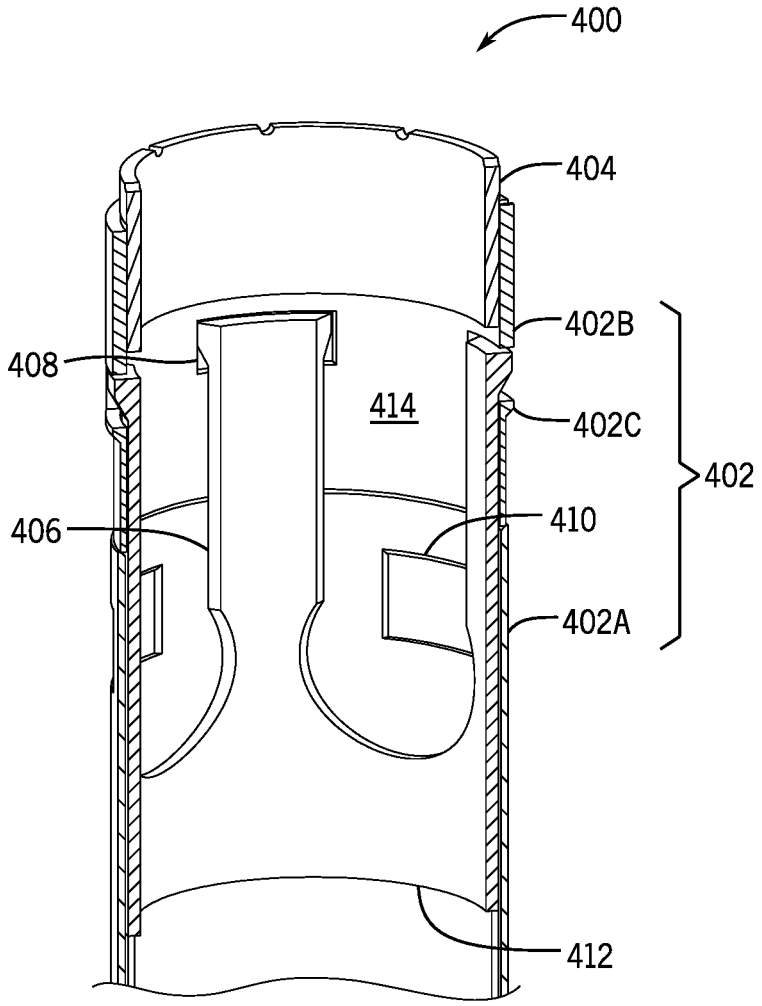
FIG. 4 depicts a schematic diagram of an annular cutter catching device having one or more collet fingers, in accordance with embodiments of the present disclosure.

FIG. 4 depicts a schematic diagram of an annular cutter catching device 400 having one or more collet fingers 406, in accordance with embodiments of the present disclosure. In certain embodiments, the annular cutter catching device 400 may include a housing 402, a cutter 404, and one or more collet fingers 406. The housing 402 may be a tubular mandrel having an inner bore 414 therethrough. In certain embodiments, the housing 402 may include a first portion 402A and a second portion 402B. In certain embodiments, the first portion 402A may include one or more apertures 410. In addition, in certain embodiments, the second portion 402B may include one or more apertures 408. In certain embodiments, the second portion 402B may include one or more flanges 402C, which may include a tapered outer surface. In certain embodiments, the first portion 402A may be movable relative to the second portion 402B. The cutter 404 may cut a coupon. In certain embodiments, the cutter 404 may be coupled to the housing 402.

In certain embodiments, the one or more collet fingers 406 may be coupled to a ring 412. In certain embodiments, each of the one or more collet fingers 406 may include a tapered outer surface at an axial end closest to the cutter 404. The one or more collet fingers 406 may be movably disposed within the inner bore 414 of the housing 402. In certain embodiments, the one or more collet fingers 406 may be movable between a first position (shown in FIG. 4) and a second position. In the first position illustrated in FIG. 4, each of the one or more collet fingers 406 may be at least partially radially disposed in a corresponding aperture 408 of the one or more apertures 408. In the second position, each of the one or more collet fingers 406 may be forced at least partially radially inward towards a longitudinal axis of the annular cutter catching device 400. When in the second position, the one or more collet fingers 406 may engage an outer surface (e.g., outer surface 122 of the coupon 120 in FIG. 1) of a coupon. In particular, in the second position, the one or more collet fingers 406 may grip and/or retain the coupon.

In certain embodiments, the one or more flanges 402C may engage a corresponding collet finger 406 of the one or more collet fingers 406. For example, in certain embodiments, when the one or more collet fingers 406 slide axially relative to the one or more flanges 402C, the one or more flanges 402C may act on the tapered outer surface of the one or more collet fingers 406 to move the one or more collet fingers 406 from the first position to the second position. In certain embodiments, the one or more collet fingers 406 may be biased towards the second position. For example, the first portion 402A of the housing 402 may be biased towards engagement of the one or more flanges 402C with a corresponding one of the one or more collet fingers 406. In certain embodiments, applying a weight to the cutter 404 during cutting may apply an axial force against the one or more collet fingers 406 where the cutter 404 abuts the one or more collet fingers 406, thereby acting against the biasing force, and moving the one or more collet fingers 406 from the second position to the first position. As such, friction against the one or more collet fingers 406 may be reduced during cutting and wear on the one or more collet fingers 406 may be reduced.

Figure 5:
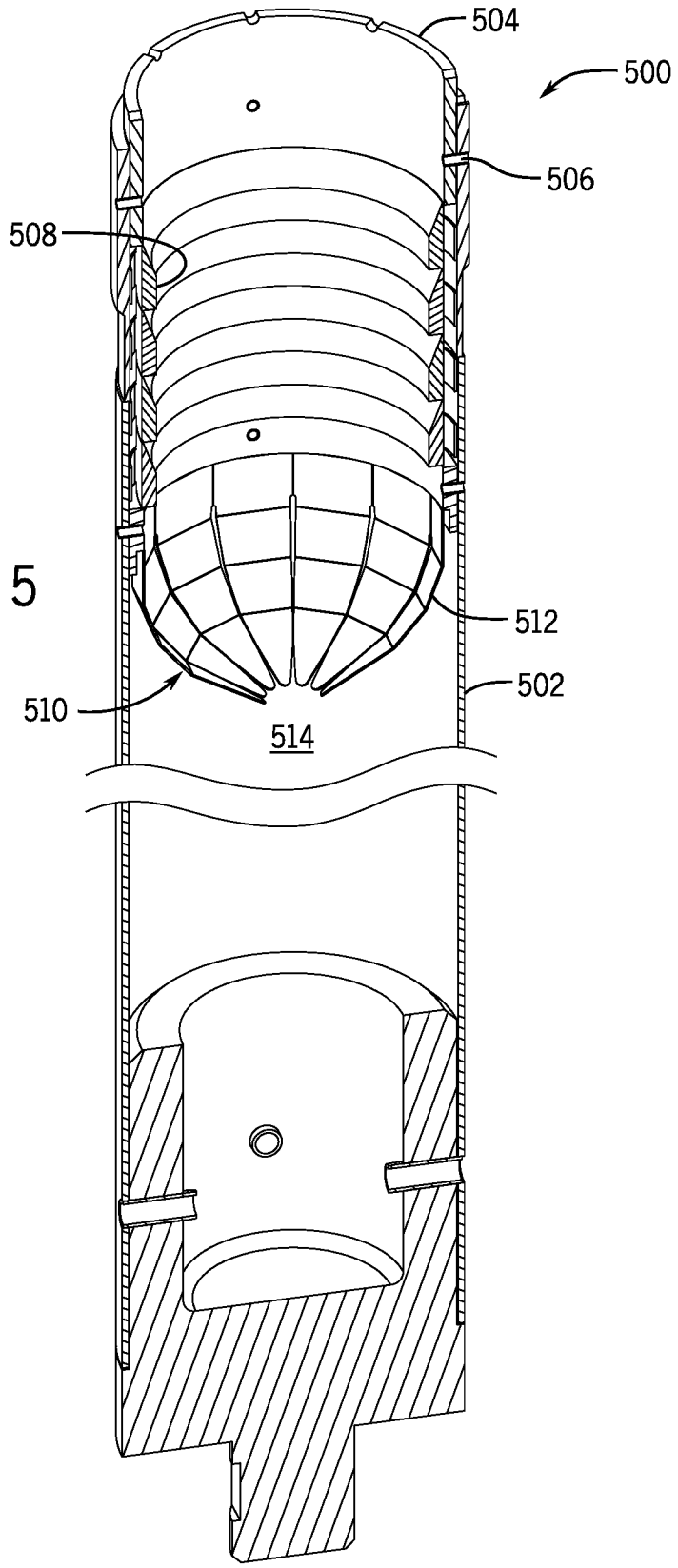
FIG. 5 depicts a schematic diagram of an annular cutter catching device having a coupon catcher, in accordance with embodiments of the present disclosure.

FIG. 5 depicts a schematic diagram of an annular cutter catching device 500 having a coupon catcher 510 and one or more split rings 508, in accordance with embodiments of the present disclosure. In certain embodiments, the annular cutter catching device 500 may include a housing 502, a cutter 504, a pin 506, one or more split rings 508, and a coupon catcher 510. The housing 502 may be a tubular mandrel having an inner bore 514 therethrough. The cutter 504 may cut a coupon. In certain embodiments, the cutter 504 may be coupled to the housing 502. For example, the pin 506 may couple the cutter 504 to the housing 502. Additionally or alternatively, the cutter 504 may be coupled to the housing 502 by a threaded connection, welding, or any other suitable connection.

In certain embodiments, the one or more split rings 508 may have a construction similar to the one or more split rings 108 illustrated in FIG. 1. The one or more split rings 508 may retain and/or grip a coupon as described above with respect to the one or more split rings 108. The coupon catcher 510 may be disposed within the inner bore 514 of the housing 502. The one or more split rings 508 may be disposed in the bore 514 of the housing 502 axially between the cutter 504 and the coupon catcher 510. In addition, in certain embodiments, the coupon catcher 510 may be disposed adjacent one of the one or more split rings 508. In certain embodiments, the coupon catcher 510 may include a set of fingers 512. In certain embodiments, the set of fingers 512 may be formed of a metal. In certain embodiments, the coupon catcher 510 may be movable between a closed position (shown in FIG. 5) and an open position. In certain embodiments, the set of fingers 512 may be biased towards the closed position. In the open position, the set of fingers 512 may be splayed radially outwardly at an axial end opposite the split rings 508. In the open position, the set of fingers 512 may permit a coupon to pass through the inner diameter of the coupon catcher 510. Conversely, in the closed position, the set of fingers 512 may be biased radially inwardly towards a longitudinal axis of the annular cutter catching device 500. In the closed position, the set of fingers 512 may prevent coupons that have previously passed through the coupon catcher 510 in a first direction away from the cutter 504 from moving back through the coupon catcher 510 in another direction. As such, the coupon catcher 510 may retain coupons that pass through the coupon catcher 510.

Figure 6A:
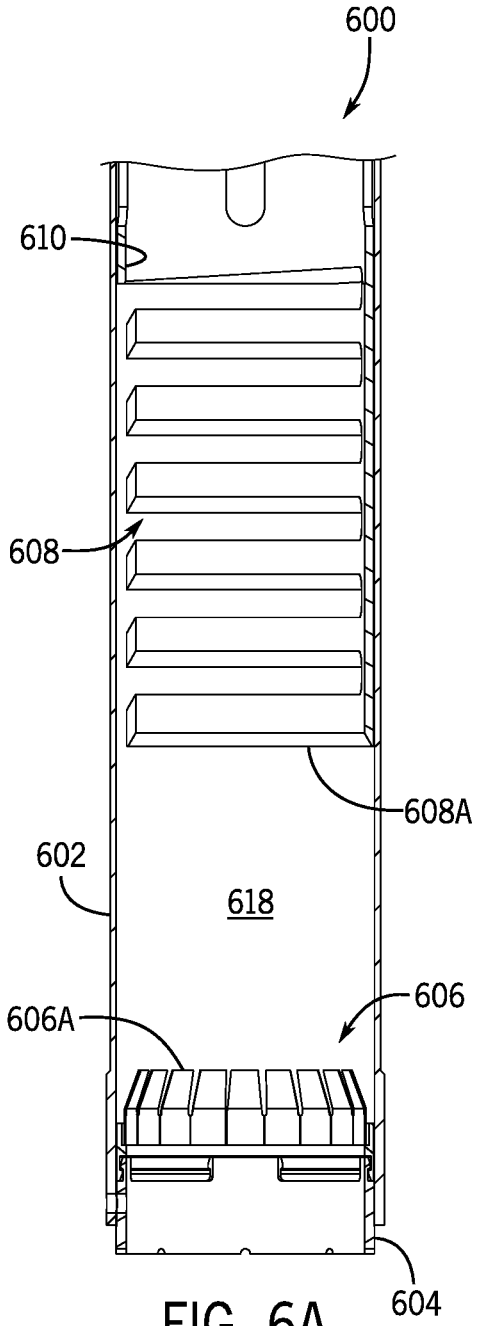
FIG. 6A depicts a schematic diagram of a first portion of an annular cutter catching device having a coupon catcher and one or more split rings, in accordance with embodiments of the present disclosure.
Figure 6B:
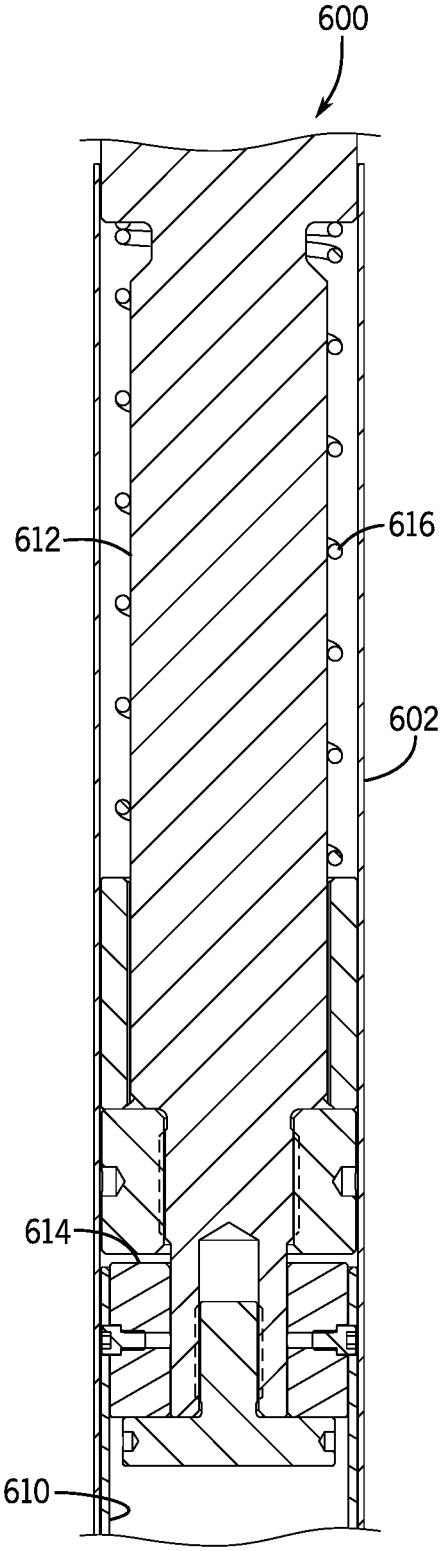
FIG. 6B depicts a schematic diagram of a second portion of the annular cutter catching device of FIG. 6A, in accordance with embodiments of the present disclosure.

FIGS. 6A and 6B depict schematic diagrams of various portions of an annular cutter catching device 600 having a coupon catcher 606 and one or more split rings 608. In certain embodiments, the annular cutter catching device 600 may include a housing 602, a cutter 604, a coupon catcher 606, and one or more split rings 608. The housing 602 may be a tubular mandrel having an inner bore 618 therethrough. The cutter 604 may cut a coupon. In certain embodiments, the cutter 604 may be coupled to the housing 602.

The coupon catcher 606 may be disposed within the inner bore 618 of the housing 602. In addition, in certain embodiments, the coupon catcher 606 may be disposed adjacent the cutter 604. In certain embodiments, the coupon catcher 606 may have a construction similar to the coupon catcher 510 illustrated in FIG. 5. The coupon catcher 606 may retain coupons as described above with respect to the coupon catcher 510. For example, the one or more split rings 608 may be disposed within the inner bore 618 of the housing 602. The coupon catcher 606 may be disposed in the bore 618 of the housing 602 axially between the cutter 604 and the one or more split rings 608. Again, in certain embodiments, the one or more split rings 608 may have a similar construction to the one or more split rings 108 illustrated in FIG. 1. The one or more split rings 608 may retain and/or grip a coupon as described above with respect to the one or more split rings 108 illustrated in FIG. 1.

The one or more split rings 608 may be coupled to a first mandrel 610. The first mandrel 610 may be a tubular mandrel having an inner bore therethrough. In certain embodiments, the one or more split rings 608 may be movable relative to the coupon catcher 606. For example, the one or more split rings 608 may be movable with the first mandrel 610 relative to the coupon catcher 606. In addition, the one or more split rings 608 may be movable within the inner bore 618 of the housing 602. In certain embodiments, the housing 602 may be coupled to a second mandrel 612. For example, in certain embodiments, the housing 602 may be coupled to the second mandrel 612 by a ring 614. The second mandrel 612 may be disposed within an inner bore 618 of the housing 602.

In certain embodiments, the second mandrel 612 may be biased axially by a spring 616 acting against the second mandrel 612. When a weight is applied to the annular cutter catching device 600 to cut a coupon, the force of the weight may be transferred through the housing 602 to the second mandrel 612. As such, a force of the weight may compress the spring 616. In response, the coupon catcher 606 and the housing 602 may move axially relative to the one or more split rings 608 and the first mandrel 610. As the cutter 604 cuts a coupon, the coupon may be forced into a set of fingers 606A of the coupon catcher 606 and into contact with one of the one or more split rings 608, such as split ring 608A. Split ring 608A may retain and/or grip the coupon as described above, with respect to the one or more split rings 108 illustrated in FIG. 1.

Once the cutter 604 finishes cutting the coupon, the weight on the annular cutter catching device 600 may be released. As such, the spring 616 may bias the second mandrel 612 toward a relaxed position, shown in FIG. 6A and FIG. 6B. The biasing force of the spring 616 may be transferred from the second mandrel 612 to the housing 602. The housing 602 and the coupon catcher 606 may move axially relative to the one or more split rings 608, the first mandrel 610, and the coupon. The movement of the coupon catcher 606 may permit the coupon to move entirely through the coupon catcher 606 as the coupon catcher 606 moves between the open position to the closed position.

Figure 7:
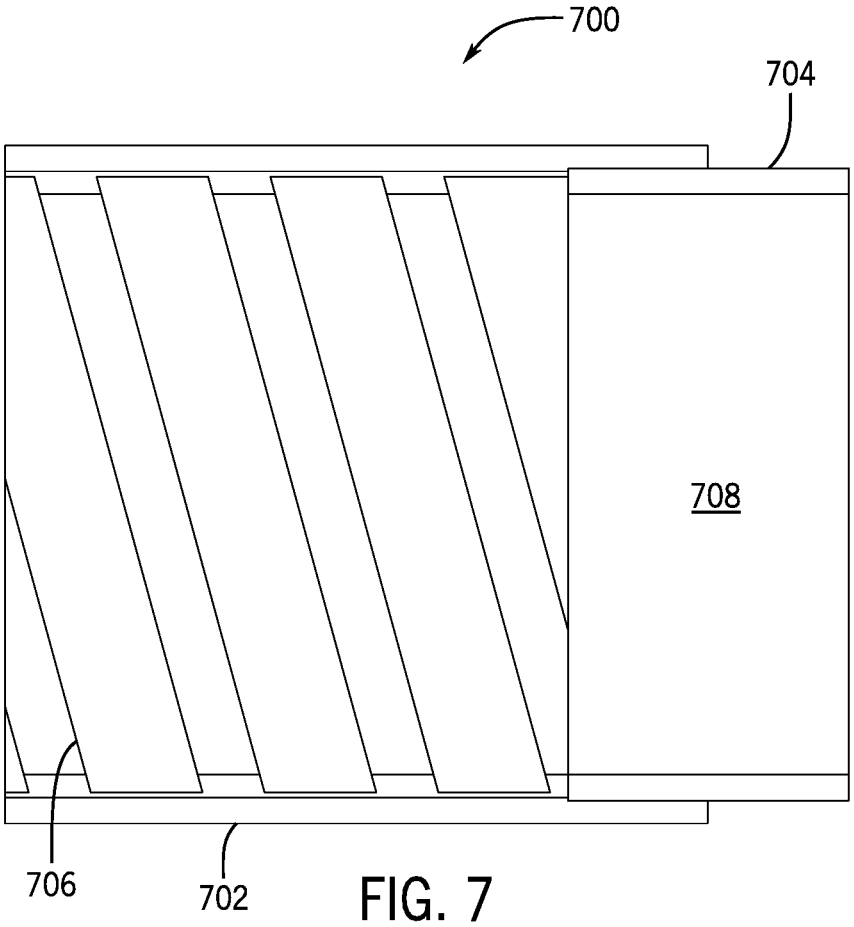
FIG. 7 depicts a schematic diagram of an annular cutter catching device having a spiral grapple, in accordance with embodiments of the present disclosure.

FIG. 7 depicts a schematic diagram of an annular cutter catching device 700 having a spiral grapple 706, in accordance with embodiments of the present disclosure. In certain embodiments, the annular cutter catching device 700 includes a housing 702, a cutter 704, and the spiral grapple 706. The housing 702 may be a tubular mandrel having an inner bore therethrough. The cutter 704 may cut a coupon. In certain embodiments, the cutter 704 may be coupled to the housing 702.

In certain embodiments, the spiral grapple 706 may be disposed within the inner bore 708 of the housing 702. In certain embodiments, the spiral grapple 706 may abut a surface opposite of a cutting surface of the cutter 704. In certain embodiments, the spiral grapple 706 may be formed from a metal. In certain embodiments, the spiral grapple 706 may have an inner diameter smaller than an inner diameter of the cutter 704. The spiral grapple 706 may receive the coupon in the inner diameter. As the coupon enters the spiral grapple 706, the spiral grapple 706 may compress. For example, the coupon may contact the inner diameter of the spiral grapple 706 and compress the spiral grapple 706, similar to a spring. The compression of the spiral grapple 706 may expand the inner diameter of the spiral grapple 706, decreasing a force on the coupon. The spiral grapple 706 may relax to an uncompressed state and grip and/or retain the coupon. A force acting on the spiral grapple 706 in the direction of the cutter 704 may extend the spiral grapple 706. For example, the tension on the spiral grapple 706 may decrease the inner diameter of the spiral grapple 706, increasing a force on the coupon.

While the present disclosure may be susceptible to various modifications and alternative forms, specific embodiments have been shown by way of example in the drawings and have been described in detail herein. However, it should be understood that the present disclosure is not intended to be limited to the particular forms disclosed. For example, while some embodiments described herein contain specific combinations of coupon catching mechanisms, other combinations may also be possible. Rather, the present disclosure is intended to cover all modifications, equivalents, and alternatives falling within the spirit and scope of the present disclosure as defined by the following appended claims.

In an embodiment, an annular cutter catching device may comprise a housing having an inner bore therethrough, a cutter configured to cut a coupon, and one or more slips movable between a first position and a second position, wherein at least one slip of the one or more slips are configured to grip the coupon within the inner bore of the housing in the second position.

Each of the one or more slips of the annular cutter catching device may comprise a first ring, and a second ring disposed within an inner diameter of the first ring, the second ring formed of an elastomeric material.

The second ring is configured to move along a surface of the first ring.

In a further embodiment, an annular cutter catching device may comprise a housing having an inner bore therethrough, a cutter configured to cut a coupon, wherein the cutter includes a cutting surface and an asymmetric surface, wherein the asymmetric surface is opposite the cutting surface, and a catch ring disposed within the inner bore of the housing, the catch ring configured to engage the asymmetric surface at a first point and to pivot about the first point to grip the coupon within the inner bore of the housing.

In a further alternative embodiment, an annular cutter catching device may comprise a housing having an inner bore therethrough, a cutter configured to cut a coupon, and a spiral grapple disposed within the inner bore of the housing, the spiral grapple configured to grip the coupon within the inner bore of the housing.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. § 112(f). However, for any claims containing elements designated in any other manner, it is intended that such elements are not to be interpreted under 35 U.S.C. § 112(f).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An annular cutter catching device, comprising:

a housing having an inner bore therethrough;

a cutter configured to cut a coupon; and a plurality of split rings disposed within the inner bore of the housing, wherein at least one split ring of the plurality of split rings is configured to grip an outer surface of the coupon within the inner bore of the housing, and wherein a successive split ring of the plurality of split rings comprises a smaller inner diameter than a diameter of a preceding split ring of the plurality of split rings.

2. The annular cutter catching device of claim 1, wherein the plurality of split rings are movable relative to the housing.

3. The annular cutter catching device of claim 1, wherein at least one split ring of the plurality of split rings includes a tapered surface formed at an end of the at least one split ring.

4. The annular cutter catching device of claim 1, wherein at least one split ring of the plurality of split rings includes an annular gap around a circumference of the at least one split ring.

5. The annular cutter catching device of claim 1, wherein each split ring of the plurality of split rings has a similar construction to others of the plurality of split rings.

6. The annular cutter catching device of claim 1, wherein the plurality of split rings are movably disposed within the inner bore of the housing.

7. The annular cutter catching device of claim 1, further comprising a set of fingers disposed within the inner bore of the housing and movable between an open position and a closed position, wherein the set of fingers is configured to retain the coupon within the inner bore of the housing in the closed position.

8. The annular cutter catching device of claim 7, wherein the set of fingers is disposed within the inner bore of the housing axially between the plurality of split rings and the cutter.

9. The annular cutter catching device of claim 7, wherein the set of fingers is configured to be splayed outwards in the open position.

10. The annular cutter catching device of claim 7, wherein the set of fingers is biased towards the closed position.

11. The annular cutter catching device of claim 7, wherein the set of fingers is configured to allow the coupon to pass through an inner diameter of the set of fingers in a first axial direction.

12. The annular cutter catching device of claim 11, wherein the set of fingers are configured to prevent the coupon from passing through an inner diameter of the set of fingers in a second axial direction opposite the first axial direction.

13. The annular cutter catching device of claim 1, wherein the plurality of split rings are disposed within the inner bore of the housing axially between the cutter and the set of fingers.

14. A method, comprising:

engaging a coupon with a coupon catcher of an annular cutter catching device having a housing having an inner bore therethrough;

moving the coupon catcher from a first position to a second position, wherein the coupon catcher comprises a plurality of fingers, and wherein the plurality of fingers are biased towards the first position;

moving the coupon through an inner diameter of the coupon catcher;

gripping the coupon with at least one split ring of a plurality of split rings disposed in the inner bore of the housing, wherein a successive split ring of the plurality of split rings comprises a smaller inner diameter than a diameter of a preceding split ring of the plurality of split rings; and retaining the coupon in the inner bore of the housing of the annular cutter catching device.

15. The method of claim 14, wherein the plurality of split rings are movable relative to the housing.

16. The method of claim 14, wherein at least one split ring of the plurality of split rings includes a tapered surface formed at an end of the at least one split ring.

17. The method of claim 14, wherein at least one split ring of the plurality of split rings includes an annular gap around a circumference of the at least one split ring.

18. The method of claim 14, wherein each split ring of the plurality of split rings has a similar construction to others of the plurality of split rings.

19. The method of claim 14, wherein the plurality of split rings are movably disposed within the inner bore of the housing.

20. The method of claim 14, wherein the plurality of split rings are disposed within the inner bore of the housing axially between a cutter of the annular cutter catching device and the plurality of fingers.

* * * * *